US008608330B2

(12) United States Patent
Kim

(10) Patent No.: US 8,608,330 B2
(45) Date of Patent: Dec. 17, 2013

(54) REFRIGERATOR AND REFRIGERATOR DOOR

(75) Inventor: Ungsu Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 367 days.

(21) Appl. No.: 12/864,199

(22) PCT Filed: Jan. 20, 2009

(86) PCT No.: PCT/KR2009/000300
§ 371 (c)(1),
(2), (4) Date: Jul. 22, 2010

(87) PCT Pub. No.: WO2009/093833
PCT Pub. Date: Jul. 30, 2009

(65) Prior Publication Data

US 2010/0319383 A1 Dec. 23, 2010

(30) Foreign Application Priority Data

Jan. 23, 2008 (KR) ..... 10-2008-0007114

(51) Int. Cl.
*F25D 27/00* (2006.01)
*F25D 23/00* (2006.01)
*F25D 23/02* (2006.01)

(52) U.S. Cl.
USPC ..... 362/92; 362/612; 312/405; 62/264

(58) Field of Classification Search
USPC ..... 362/92
See application file for complete search history.

(56) References Cited

U.S. PATENT DOCUMENTS

| | | | | | |
|---|---|---|---|---|---|
| 3,065,559 | A * | 11/1962 | McKenzie | 428/67 |
| 4,753,043 | A * | 6/1988 | Bockwinkel | 49/501 |
| 4,965,950 | A | 10/1990 | Yamada | |
| 4,974,354 | A | 12/1990 | Hembrook, Jr. | |
| 5,027,258 | A | 6/1991 | Schoniger et al. | |
| 5,599,081 | A * | 2/1997 | Revlett et al. | 312/406 |
| 5,787,618 | A | 8/1998 | Mullis | |
| 6,889,456 | B2 | 5/2005 | Shibata et al. | |
| 6,971,758 | B2 | 12/2005 | Inui et al. | |
| 7,107,712 | B2 | 9/2006 | Mueller | |
| 7,182,492 | B1 | 2/2007 | Walter | |
| 7,192,148 | B2 | 3/2007 | Tsai et al. | |
| 7,652,297 | B2 * | 1/2010 | Hon et al. | 257/81 |
| 7,752,791 | B2 | 7/2010 | Misawa et al. | |
| 8,201,977 | B2 * | 6/2012 | Thomas et al. | 362/311.02 |

(Continued)

FOREIGN PATENT DOCUMENTS

| | | | |
|---|---|---|---|
| EP | 1767661 | A1 * | 3/2007 |
| JP | 2003-79488 | A | 3/2003 |
| KR | 1999-0062163 | A | 7/1999 |

(Continued)

*Primary Examiner* — Sikha Roy
(74) *Attorney, Agent, or Firm* — Birch, Stewart, Kolasch & Birch, LLP

(57) ABSTRACT

Provided are a refrigerator and a refrigerator door. The refrigerator and refrigerator door include a transparent member provided behind an exterior member defining the exterior of the refrigerator, a light emitting member provided on an extending line of an outer end of the transparent member to radiate light toward the transparent member, and a diffusing portion formed at one side of the transparent member. Light from the light emitting member passes through the transparent member and a pattern on the exterior member to be diffused to the outside. Through this configuration producing a soft glow of light, aesthetics can be improved and opulence can be enhanced.

8 Claims, 4 Drawing Sheets

(56) References Cited

U.S. PATENT DOCUMENTS

| | | | | |
|---|---|---|---|---|
| 2004/0136171 | A1* | 7/2004 | Patton et al. | 362/31 |
| 2004/0183413 | A1* | 9/2004 | Koo | 312/401 |
| 2006/0075696 | A1* | 4/2006 | Alessandro | 52/171.1 |
| 2006/0272235 | A1* | 12/2006 | Leimkuehler et al. | 52/204.1 |
| 2007/0097295 | A1* | 5/2007 | Hebrank et al. | 349/113 |
| 2008/0042537 | A1* | 2/2008 | Kim et al. | 312/405 |
| 2010/0019639 | A1* | 1/2010 | Son | 312/403 |

FOREIGN PATENT DOCUMENTS

| | | | |
|---|---|---|---|
| KR | 10-0286035 | B1 | 1/2001 |
| KR | 10-2005-00976002 | A | 10/2005 |
| KR | 10-2006-0116349 | A | 11/2006 |
| WO | WO 2008084928 | A * | 7/2008 |

* cited by examiner

REFRIGERATOR AND REFRIGERATOR DOOR

TECHNICAL FIELD

The present invention relates to a refrigerator and a refrigerator door.

BACKGROUND ART

In general, a refrigerator is a household appliance that can store foods at low temperatures in a storage compartment within that is opened and closed by a refrigerator door, and is configured to preserve stored foods in optimal states through cooling its interior using cold air generated by heat exchange of refrigerant that circulates in a refrigeration cycle.

Such refrigerators are gradually undergoing increases in size and multi-functional capability due to changes in eating habits and the trend of making products more luxury-oriented, so that refrigerators are now being produced with various structures and convenience features for enhancing user convenience.

Recently, because an important deciding factor for purchasing a refrigerator has become the design of the refrigerator (in addition to its function), refrigerators having a wide assortment of colors, textures, patterns, etc. are being developed.

In light of modern trends for improving the overall design of refrigerators and making them more luxury-oriented, front surfaces of the main body or door of a refrigerator are typically formed of vinyl-coated metal (VCM) sheets printed with diverse colors and patterns; or, for a more varied representation of color and texture and for a high-quality feel, tempered glass is used to entirely or partially form a refrigerator exterior.

Korean Patent Publication No. 10-2007-0069665 discloses a structure with a light emitting diode (LED) light mounted on a refrigerator door handle to not only enable identification of the handle, but to also improve aesthetics.

However, the refrigerator disclosed in Korean Patent Publication No. 10-2007-0069665 only emits light from the door handle to increase the ability to identify the door handle, and cannot effectively represent patterns formed on the front surface of the door under low ambient lighting, and is unsuitable for use as mood lamp lighting, etc.

DISCLOSURE OF INVENTION

Technical Problem

Embodiments provide a refrigerator configured with a transparent member to the rear of an exterior member that defines the exterior of the refrigerator, and a light emitting member to the outside of the transparent member, so that light emitted from the light emitting member passes through the transparent member and through a pattern on the exterior member and diffuses to the outside.

Embodiments also provide a refrigerator door configured with a transparent member to the rear of an exterior member that defines the exterior of the refrigerator, and a light emitting member to the outside of the transparent member, so that light emitted from the light emitting member passes through the transparent member and through a pattern on the exterior member and diffuses to the outside.

Technical Solution

In one embodiment, a refrigerator door includes: an exterior member defining an exterior of the refrigerator door, and having light transmitted through a side thereof; a transparent member provided behind the exterior member; a light emitting member provided on an extending line of an outer end of the transparent member, for radiating light toward the transparent member; and a diffusing portion formed at one side of the transparent member, for diffusing light transmitted through the transparent member.

In another embodiment, a refrigerator door includes: an outer door panel defining an external form of the refrigerator door; a support plate provided in front of the outer door panel, and including a decorative member mounted to a front side thereof; a transparent member provided in front of the support plate, and open at a position corresponding to a position at which the decorative member is mounted; a light emitting member provided outside the transparent member, for radiating light into the transparent member through an end of the transparent member; and an exterior member provided frontmost on the refrigerator door to define a front exterior thereof, and formed of tempered glass or plastic material to outwardly transmit a portion of light transmitted through the transparent member.

In a further embodiment, a refrigerator includes: a main body defining a storage compartment; a door selectively closing the storage compartment of the main body; an exterior member formed of tempered glass or plastic material to define a front exterior of the door, and including a transmitting portion formed thereon to outwardly emit light from inside the door through a design formed on a surface thereof; a light emitting member provided in plurality behind the exterior member to diffuse light from outsides of the transmitting portion towards one another; and a transparent member interposed between the light emitting members to transmit light incident on ends thereof to the transmitting portion through diffusion.

In a still further embodiment, a refrigerator includes: a main body defining a storage compartment; an exterior member of tempered glass or plastic material provided on a front surface of the main body, for transmitting light outward from an inside along a design on a surface thereof; a transparent member provided behind the exterior member and formed of a size to cover an entirety of the design; a light emitting member provided on at least one end of the transparent member to radiate light to an inside of the transparent member; and a diffusing portion projecting or recessed on a surface of the transparent member to diffuse light radiated to the transparent member.

Advantageous Effects

According to disclosed embodiments of the present invention, a light emitting member that emits light is not exposed to the outside, and light emitted from the light emitting member passes through a transparent member and is then scattered through an exterior member to the outside.

Accordingly, because annoyance from directly radiated light can be reduced, and a tranquil atmosphere can be offered to users, emotional dissatisfaction of users arising from direct light can be alleviated.

Also, light radiated through the exterior member can have the same effect as indirect lights such as mood lamps so that a new level for door exterior luxury can be attained.

In addition, the light emitting member is maintained in an OFF state when the level of brightness is sufficient to discern patterns represented on the exterior member, and the light emitting member is turned ON in an environment with a low brightness level inconducive to pattern discernment. Thus, through the operation of the light emitting member, patterns can be highlighted and certain portions can be accentuated, so that the exterior of a refrigerator can be given an added element of refinement.

Furthermore, a decorative member is mounted on the inside corresponding to the portion through which light passes, thus exuding a three-dimensional feel and enabling highlighting of designs in order to render other competing products incomparable in terms of design.

MODE FOR THE INVENTION

Reference will now be made in detail to embodiments of the present invention, examples of which are illustrated in the accompanying drawings. It should be understood, however, that the present invention is not limited to embodiments disclosed herein, and that other embodiments can easily be devised to fall within the spirit and scope of the present invention by adding, modifying, and removing elements.

While the exterior member formed of tempered glass or plastic material for a refrigerator and refrigerator door according to the present invention can be applied to all types of refrigerators, a description will be given below of the exterior member applied to a French door type refrigerator and a chest type refrigerator with lids, as examples for the sake of descriptive convenience and ease of understanding.

Figure 1:
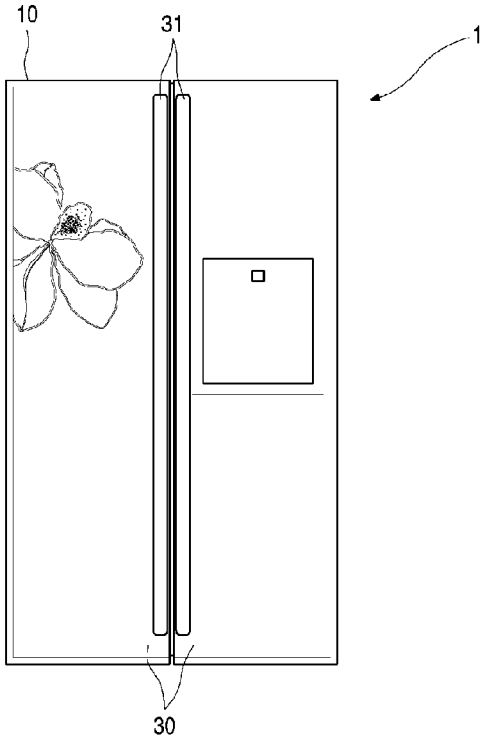
FIG. 1 is a frontal view showing the exterior of a refrigerator according to embodiments of the present invention.

FIG. 1 is a frontal view showing the exterior of a refrigerator according to embodiments of the present invention. Referring to FIG. 1, a refrigerator 1 has an approximate hexahedral shape overall, has a main body 10 that is partitioned inside with at least one storage compartment, and a door 30 that opens and closes the main body 10.

The main body 10 is formed in a hexahedral shape with an open front, and the main body 10 defines a storage compartment in which to store foods. The storage compartment is partitioned to the left and right that define a refrigeration compartment and a freezer compartment, respectively, and each storage compartment is selectively opened and closed by a door 30.

The door 30 selectively closes the open front of the refrigerator 1—that is, the refrigeration compartment and the freezer compartment—and is formed in the same shapes as the open sides of the refrigeration compartment and the freezer compartment. The doors 30 are respectively coupled via hinges to the main body 10 to be capable of pivoting to the left and right, and the refrigeration compartment and the freezer compartment are selectively opened and closed through the pivoting of the doors 30. Also, when the door 30 is closed, it contains cold air within a storage compartment, and also defines the front exterior of the refrigerator 1.

A handle 31 is provided on the front surface of the door 30 for a user to grasp in order to pivot the door 30, and while not shown, a display for checking the operating state of the refrigerator, a homebar enabling easy access to food inside a storage compartment, and a dispenser for dispensing water or ice may be provided on the front surface.

Various designs (such as a flower design in FIG. 1) may be formed on the front surface of the door 30, and light may be diffused through the designs of the door 30 when the brightness level of the interior in which the refrigerator 1 is installed is low, to perform the function of lighting such as mood lamps.

Figure 2:
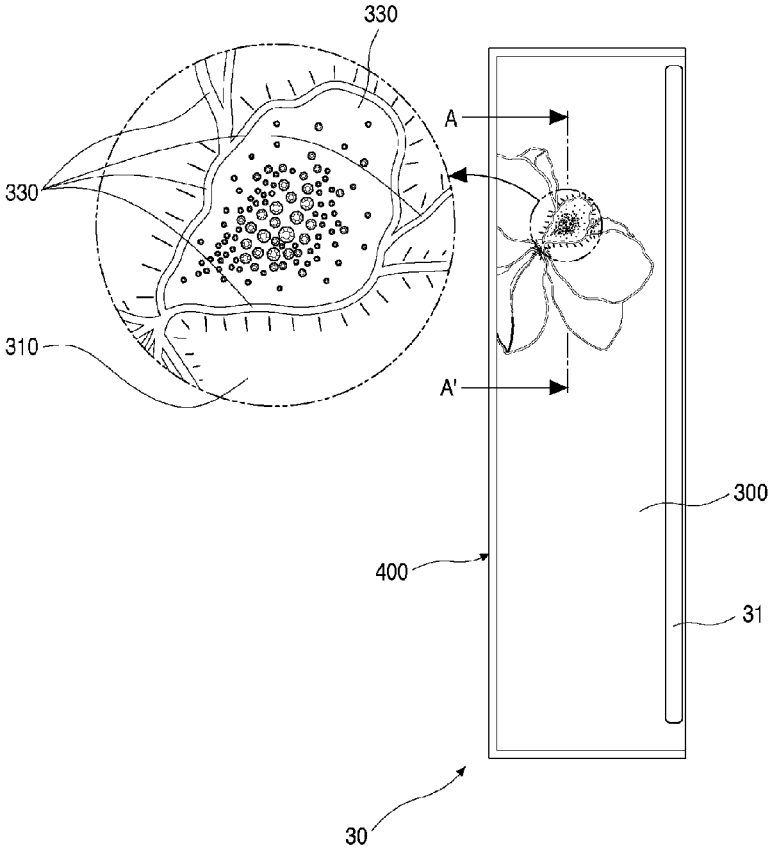
FIG. 2 is a perspective view showing the outer shape of a refrigerator door according to embodiments of the present invention.
Figure 3:
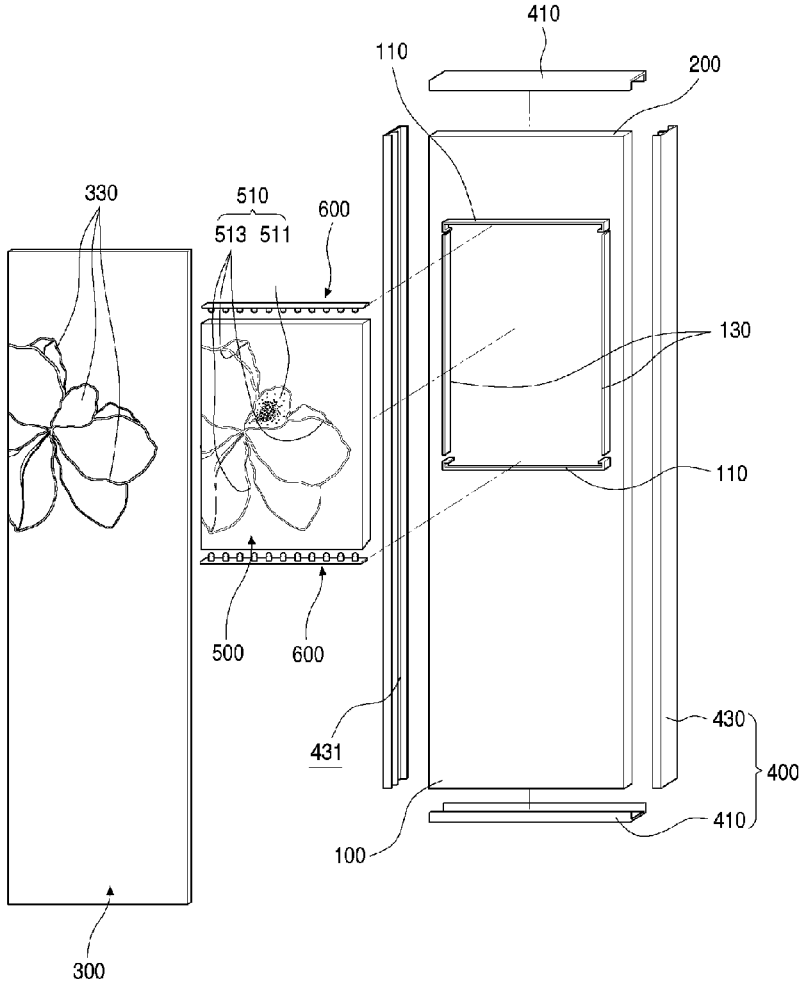
FIG. 3 is an exploded perspective view showing the structure of a refrigerator door according to embodiments of the present invention.

FIG. 2 is a perspective view showing the outer shape of a refrigerator door according to embodiments of the present invention, and FIG. 3 is an exploded perspective view showing the structure of a refrigerator door according to embodiments of the present invention. Also, FIG. 4 is a schematic sectional view showing the structure of a refrigerator door according to embodiments of the present invention.

Figure 4:
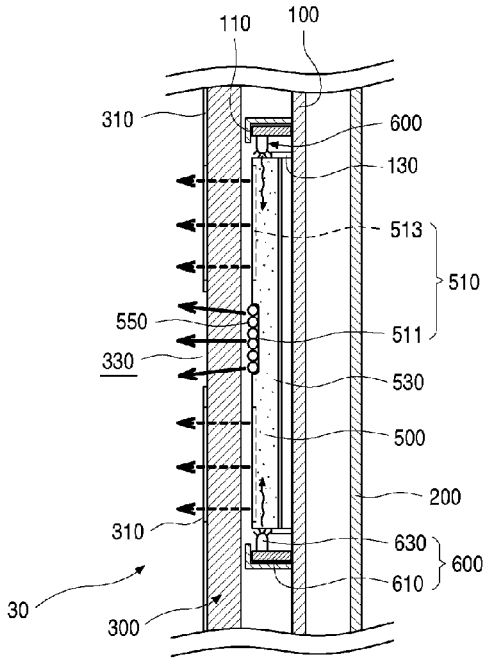
FIG. 4 is a schematic sectional view showing the structure of a refrigerator door according to embodiments of the present invention.

Referring to FIGS. 2 to 4, the above door will be described in further detail below.

The door 30 is roughly rectangular in shape, and is formed in overall structure through coupling of an outer door panel 100 and a door liner 200, an exterior member 300, and deco members 400 that fix the former elements.

The outer door panel 100 constitutes the overall exterior shape of the door 30, and is a rectangular metal sheet with a bent perimeter. Light emitting member mounts 110, to which a light emitting member 600 (described below) is mounted, are formed to respectively project from the front surface of the outer door panel 100.

The door liner 200 defines the rear surface of the door 30, and is formed of a plastic material. Also, a formed step may be formed in the door liner 200 to mount a storage member (not shown) for storing foods, or a separate compartment may be formed.

The outer door panel 100 and the door liner 200 are spaced apart to form a gap therebetween, and an insulation material is provided in the gap. The insulation material is formed by injecting and filling an expandable liquid of Expandable poly-styrene (EPS) in the closed gap between the outer door panel 100 and the door liner 200. This is the same as that used in typical refrigerator doors.

The deco members 400 are formed at the top and bottom and left and right on the outer door panel 100 and the door liner 200. The deco members 400 enable the outer door panel 100 and the door liner 200 to be coupled while separated from one another, and form the peripheral surface of the door 30 when coupled.

In further detail, the deco members 400 are formed as cap decos 410 disposed at the top and bottom ends of the door 30, and side decos 430 disposed on the left and right sides of the door 30. The cap decos 410 enclose the upper ends and lower ends of the outer door panel 100 and the door liner 200, respectively, and the side decos 430 enclose the left and right ends of the outer door panel 100 and the door liner 200, respectively.

In particular, the side decos 430 define an exterior member holder 431 to which the exterior member 300 defining the front surface of the door 30 can be mounted. The exterior member holder 431 defines a space with ribs projecting inward from the side decos 430, and the ends of the exterior member 300 are inserted in the spaces.

The exterior member holder 431 is formed on the leading edge of the side deco 430, and thus, the exterior member 300 can be disposed at the front surface of the door 30. Also, a space is defined between the exterior member 300 and the outer door panel 100 in order to mount a transparent member 500 and a light emitting member 600 (to be described below in detail) therein.

The exterior member 300 is formed of tempered steel or plastic material through which light can pass, and a printed portion 310 is formed on the front surface or rear surface of the exterior member 300. The printed portion 310 is for shielding and preventing a portion of light emitted from the light emitting member 600 (described below) from passing to the outside, and is formed through color treatment with ink that is the background color of the exterior member 300 or through attaching a sheet that can shield light.

Here, portions of the exterior member 300 that are not printed have a transmitting portion 330 formed thereon, through which light from the rear of the exterior member 300 can pass. The transmitting portion 330 is a portion that is not color treated so that it can transmit light, is formed continuously in a predetermined shape, and, as shown in the diagrams, defines a pattern in the shape of flower petals when viewed from the front. Of course, the formation of such designs can be diverse, and logos and lettering may be formed if required.

The printed portion 310 is determined by the shape of the design, and the areas other than the printed portion 310 that are not colored become the transmitting portion 330 by default. The transmitting portion 330 may be treated to be semitransparent when needed, in order to improve aesthetic sensibility through forming locally brighter regions and darker regions by coloring regions with a light transmitting paint or attaching films thereto.

A transparent member 500 is disposed at the rear of the exterior member 300. The transparent member 500 is for transmitting light emitted from the light emitting member 600, may be formed in the same size as the exterior member 300, and may be formed of a size capable of covering the entire design formed on the exterior member 300.

The transparent member 500 may be formed of an acrylic material that can effectively transmit light emitted from the light emitting member 600, and a diffusing portion 510 is formed on the surface of the transparent member 500 to diffuse radiated light through the transmitting portion 330.

The diffusing portion 510 is formed in the same shape as the design formed on the exterior member, or in a corresponding position and shape to the transmitting portion 330, and projects forward or is recessed rearward to diffuse light to the transmitting portion 330. For example, the diffusing portion 510 may be formed in a sectional 'V'shape to effectively diffuse light, and may be formed to diffuse light transmitted from the light emitting member 600 toward the transmitting portion 330.

In further detail, the diffusing portion 510 is configured with a main diffusing portion 511 and an auxiliary diffusing portion 513. The main diffusing portion 511 diffuses a comparatively greater amount of light over a larger surface area to form the brightest region—that is, the central region of the flower design shown in FIG. 2, and the decorative member 550 is attached to the main diffusing portion 511 to further accentuate the design.

The decorative member 550 is formed of a material such as crystal or glass fragments, and is attached so that it is visible through the transmitting portion 330 from the outside. The decorative member 550 may have a variety of configurations, and is mounted to project slightly on the diffusing portion 510 to have three-dimensionality. Thus, light diffused at the diffusing portion 510 may be refracted or reflected by the decorative member 550 in order to form more three-dimensional external shapes.

Also, the auxiliary diffusing portion 513 has a comparatively smaller width than the main diffusing portion 511, and diffuses a comparatively smaller amount of light. In addition, the auxiliary diffusing portion 513 is formed to define contour lines of the flower design in FIG. 2 to enliven three-dimensionality.

Further, a printed layer 530 of assorted colors is formed on the rear surface of the transparent member 500. The printed layer 530 is formed of a color other than that printed on the exterior member 300, so that when it is overlapped with the color of the exterior member 300 or exposed through the transmitting member 330, it can make the design represented on the exterior member 300 more distinctive.

The transparent member 500 is mounted on the outer door panel 100, and is fixed by means of an adhesive, or is fixed in position by means of a transparent member fixing portion 130 recessed or projecting in a shape corresponding to the outer door panel 100.

To describe the outside of the transparent member 500 in further detail, the top end and bottom end of the transparent member 500 are provided with a light emitting member 600. The light emitting member 600 is a source of light to be diffused through the transmitting portion 330 of the exterior member 300, and is configured to radiate light toward the transparent member 500.

The light emitting member 600 is configured with a light emitting diode (LED) 630 and a substrate 610, and a plurality of LEDS 630 is arranged in-line along the end of the transparent member 500. Here, the plurality of LEDs 630 is installed on one substrate 610, and the substrate 610 is inserted in or confined by a light emitting member mount 110 formed on the outer door panel 100 to determine the mounting position of the light emitting member 600.

Of course, depending on requirements, the light emitting member 600 may be configured as a chip LED having one LED mounted on one substrate, and a plurality of these chip LEDs may be arranged at predetermined intervals to configure the light emitting member 600.

As shown in FIG. 4, which is a sectional view of FIG. 2 taken along line A-A', the light emitting member 600 is provided with an LED provided on a line extending along the top end and bottom end of the transparent member 500 to radiate light, and is provided to radiate light toward the top end and lower end, respectively, of the transparent member 500. Thus, the light emitted from the light emitting member 600 is transmitted through the end portions of the transparent member 500 so that it can be diffused at the diffusing portion 510.

Of course, the light emitting member 600 may replace the LED with another type of light source, and may employ various types of light sources that can radiate light toward the ends of the transparent member 500.

Also, the light emitting member 600 may be installed on only one end from the top end and bottom end of the transparent member 500, or may be installed on the left and right ends or on all the ends along the entire perimeter of the transparent member 500, depending on requirements.

The operation of the above-configured refrigerator will be described below, with reference to the drawings.

When the door 30 of the refrigerator 1 is closed, the exterior member 300 is exposed toward the front to define the exterior.

When the luminance of an indoor space in which the refrigerator 1 is disposed is high for sufficient brightness, the light emitting member 600 installed within the door 30 of the refrigerator 1 does not operate. Also, when a portion of the transparent member 500 is exposed through the transmitting portion 330 defined along the design of the exterior member 300, the design on the exterior member 300 is represented three-dimensionally by the printed portion 310 and transmitting portion 330 of the exterior member 300 and the printed layer 530 of the transparent member 500.

Additionally, because the plurality of decorative members 550 mounted on the transparent member 500 is exposed to the outside through the transmitting portion 330, the decorative members 550 can sparkle from external light to make the exterior design more sophisticated.

If the brightness of the interior in which the refrigerator 1 is installed falls below a certain level, the interior becomes dark, and a user is thus unable to discern the front of the door 30, or the design represented on the exterior member 300.

Accordingly, when the interior brightness falls below a certain level, the light emitting member 600 can be turned on through a user's action or by means of a sensor that detects brightness. When the light emitting member 600 is turned on, the light emitted from the light emitting member 600 is transmitted through the end of the transparent member 500 into the transparent member 500.

The light transmitted into the transparent member 500 is diffused and directed forward by the diffusing portion 510 recessed into or projecting from the surface of the transparent member 500. Here, the slope or shape of the diffusing portion 510 enables light to be diffused and emitted, and the diffusing portion 510 is formed in a position corresponding to the transmitting portion 330 of the exterior member 300 to emit light toward the transmitting portion 330.

In particular, diffusion of light is concentrated at the main diffusing portion 511 of the diffusing portion 510 on which the plurality of decorative members 550 is mounted to yield plenty of light, and the amount of light emitted from the auxiliary diffusing portion 513 in regions outside the main diffusing portion 511 is comparatively less.

The light thus diffused at the diffusing portion 510 passes through the transmitting portion of the exterior member 300 and is radiated to the outside. Here, the light radiated to the outside through the exterior member 300 accentuates the design represented on the exterior member 300, and three-dimensionality is constructed by the decorative member 550 and the auxiliary diffusing portion 513.

That is, the region of the transmitting portion 330 corresponding to the position at which the auxiliary member 550 is installed is the brightest with plenty of light, and the auxiliary member 550 is highlighted due to refraction and reflection of light by the auxiliary member 550. Also, an edge portion corresponding to the auxiliary diffusing portion 513—that is, the perimeter of the flower design shown in FIG. 2—is made to progressively darken toward the outside from a position at the main diffusing portion 510 where the decorative member 550 is located, so that three-dimensionality can be represented.

Light that is radiated through the transmitting portion 330 of the exterior member 300 can make the position of the refrigerator and the position of the handle 31 discernible, and diffused and scattered light through the transparent member 500 and the exterior member 300 functions like a soft mood lamp.

A refrigerator according to the present invention can be embodied as in the above embodiments and also as other embodiments, which will be described below with reference to the drawings.

The structure of a refrigerator door according to another embodiment is similar to the structure of the refrigerator doors described above, and therefore, same elements will not be described in detail, and like reference numerals will be used in their description.

Figure 5:
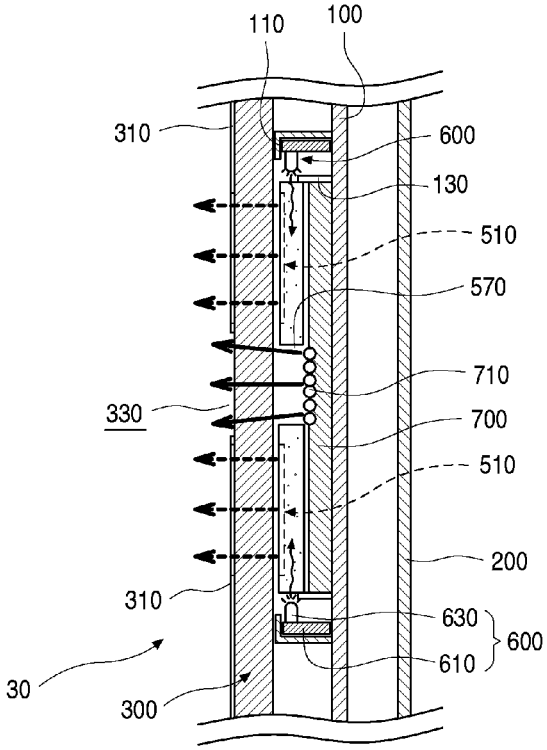
FIG. 5 is a schematic sectional view showing the structure of a refrigerator door according to embodiments of the present invention.

FIG. 5 is a schematic sectional view showing the structure of a refrigerator door according to embodiments of the present invention, and as shown in the drawing, the front exterior of the door 30 is defined by an exterior member 300, and the exterior member 300 has a printed portion 310 that blocks light, and a transmitting portion 330 that transmits light formed respectively thereon.

Also, a transparent member 500 formed of a transparent material such as acrylic is formed behind the exterior member 300, and an opening 570 is formed open at one side of the transparent member 500—or more specifically—the side facing the transmitting portion 330. Also, a diffusing portion 510 is further formed on the surface of the transparent member 500 in a recessed or projecting configuration according to the shape of the transmitting portion 330.

A light emitting member 600 configured with an LED is provided in plurality at either top and bottom ends of the transparent member 500, where the light emitting members 600 are continuously arranged along at least one end of the transparent member 500. Also, the light emitting members 600 are fixed to a light emitting member mount 110 formed on the front surface of the outer door panel 100 that defines the shape of the door 30.

A support plate 700 is provided at the rear of the transparent member 500. The support plate 700 is for mounting the light emitting member 600, is formed of a size corresponding to the size of the transparent member 500, and includes a plurality of decorative members 710 mounted at positions corresponding to the opening 570 of the transparent member 500.

The transparent member 500 and the support plate 700 are pressed against one another, and are fixedly installed by means of a transparent member fixing portion 130 provided at the front surface of the outer door panel 100.

As with refrigerators according to embodiments described above, in the case of refrigerators according to other embodiments of the present invention, when the lighting of an interior in which the refrigerator 1 is installed falls below a predetermined level, the light emitting portion 600 is operated, and the light radiated from the light emitting portion 600 passes through the end of the transparent member 500 and is transferred to the inside of the transparent member 500.

Then, the light transmitted through the transparent member 500 is diffused at the diffusing portion 510 and the opening 570 and is diffused to the outside through a transmitting portion 330 of the exterior member 300 formed at a position corresponding to the diffused light. In particular, the size of the opening 570 at which the decorative members 550 are mounted is comparatively larger than the size of the diffusing portion 510 so that the opening 570 is made comparatively brighter due to ample light, and the reflecting and refracting of light by the decorative members 550 further aids in three-dimensional representation.

A refrigerator according to the present invention may be embodied in embodiments other than the above-described embodiments, particularly, in that the present invention may be applied not only to a refrigerator door, but also to a refrigerator main body. With reference to the drawings, other embodiments of a refrigerator according to the present invention will be described below.

A refrigerator according to another embodiment of the present invention is similar in structure to the above-described refrigerators, and is different in terms of what the present invention is applied to. Therefore, detailed description of elements in the refrigerator that are the same as those in refrigerators described above will be omitted, and like reference numerals will be used to describe these elements.

Figure 6:
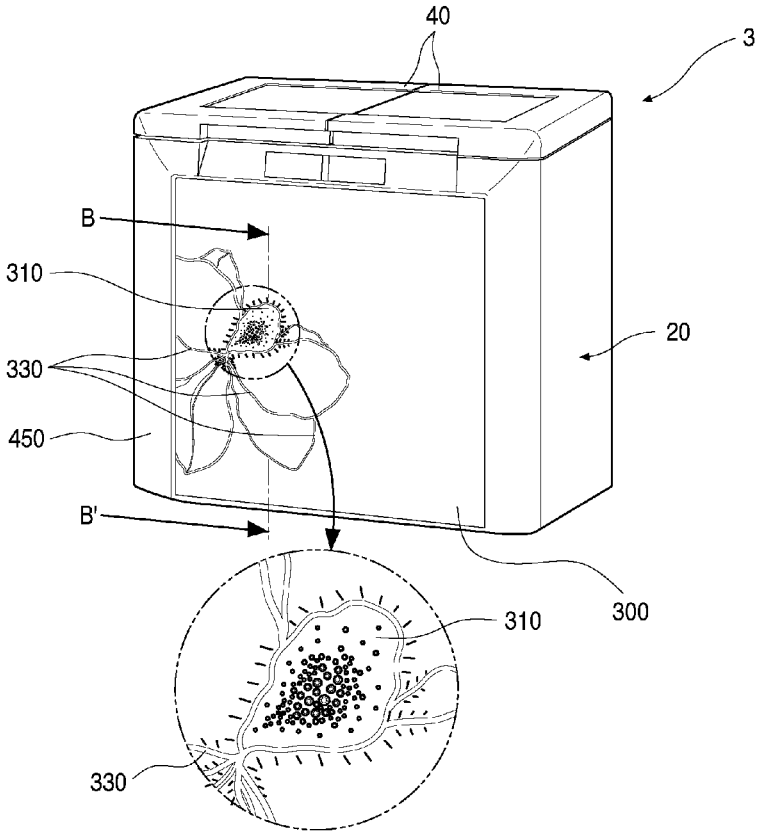
FIG. 6 is a perspective view showing the exterior of a refrigerator according to other embodiments of the present invention.
Figure 7:
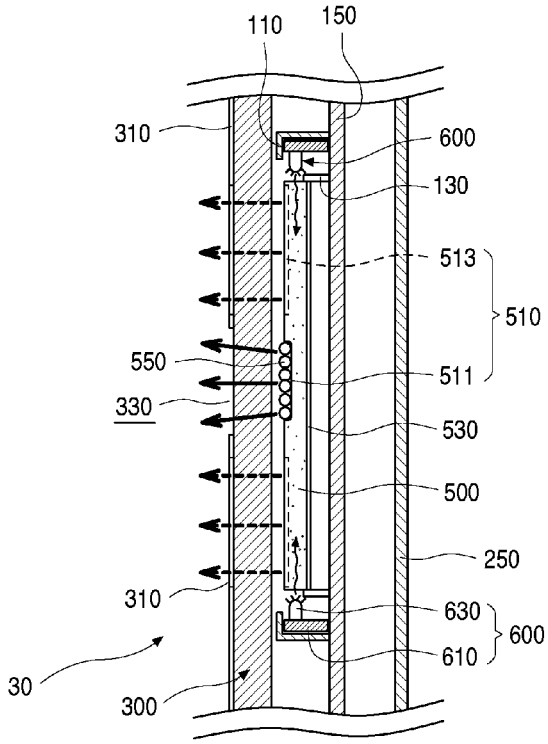
FIG. 7 is a schematic sectional view showing the structure of a main body for a refrigerator according to other embodiments of the present invention.

FIG. 6 is a perspective view showing the exterior of a refrigerator according to other embodiments of the present invention, and FIG. 7 is a schematic sectional view showing the structure of a main body for a refrigerator according to other embodiments of the present invention. FIG. 7 is a sectional view of FIG. 6 taken along line B-B'.

As shown in FIGS. 6 and 7, the exterior of a refrigerator 3 is defined by a main body 20 formed in an approximately hexahedral shape, and a door 40 that opens and closes the main body 20.

The main body 20 defines a storage compartment open at the top, and the storage compartment is partitioned into a plurality of storage compartments if needed. The storage compartment is partitioned to the left and right in FIG. 6.

Also, the door 40 is mounted at the open top of the main body 20 to be capable of pivoting. Through pivoting, the door 40 selectively closes the open top of the main body 20 (or the storage compartment) and also defines the upper surface of the refrigerator 3 when the door 40 is closed.

The door 40 is formed in a corresponding shape enabling it to close the respective storage compartments partitioned in the main body 20, and may be configured to be capable of pivoting upward in order to selectively close the open tops of the storage compartments.

The main body 20 is configured with an outer case 150 that constitutes the exterior thereof and an inner case 250 that constitutes the interior shape (or defines the storage compartments), and an insulating material is filled between the outer case 150 and the inner case 250.

Also, an exterior member 300 defining an exterior is provided at the front of the outer case 150. The exterior member 300 is installed slightly separated from the outer case 150 by means of deco members 450 defining the outside or the edges of the exterior member 300.

The exterior member 300 has a printed portion 310 for blocking light and a transmitting portion 330 for transmitting light formed respectively thereon, where the transmitting portion 330 is continuously formed to define the flower shape shown in the drawings.

A transparent member 500 is provided behind the exterior member 300, and a printed layer 530 is formed behind the transparent member 500. Also, light emitting members 600 are provided at opposite positions at the top and bottom ends of the transparent member 500.

The light emitting member 600 is configured to include an LED 630 and a substrate 610, and light from the light emitting members 600 is radiated toward the opposite ends of the transparent member 500. Also, the transparent member 500 is fixed by means of a transparent member fixing portion 130 formed on the front surface of the outer case 150, and the light emitting members 600 are installed by means of light emitting member mounts 110.

Also, the transparent member 500 is formed of a material such as acrylic to permit transmission of light, and a diffusing portion 510 is formed on the transparent member 500 in the same location as a transmitting portion 330 of the exterior member 300.

The diffusing portion 510 is formed recessed or projecting, to diffuse light transmitted from the light emitting member 600 toward the transmitting portion 330. Thus, light can be radiated from the inside of the transmitting portion 330 of the exterior member 300.

The diffusing portion 510 is configured with a main diffusing portion 511 and an auxiliary diffusing portion 513, and a decorative member 550 is mounted in the main diffusing portion 511 that has a comparatively greater amount of diffused light due to a greater area. The decorative member 550 is not only formed so that it is visible through the exterior member 300, it is also configured to be more three-dimensional through light diffused through the main diffusing portion 511, so that it can identify and highlight a design overall. The auxiliary diffusing portion 513 has a smaller width compared to the main diffusing portion 511, and is formed in a shape corresponding to the perimeter of the flower design.

Of course, in the above-described further embodiment of the present invention, the light emitting member 600 is also turned ON when the interior in which the refrigerator 3 is installed has low lighting, so that as the light emitting member 600 is turned ON, the radiated light is incident on the outer ends of the transparent member 500 and is diffused to the outside through the diffusing portion 510. Also, the light diffused through the diffusing portion 510 is diffused outward through the transmitting portion 330 of the exterior member 300.

In particular, the one side of the exterior member 300 positioned opposite the decorative member 550 becomes the brightest region, thus further highlighting the gemstone 550 member. In addition, the light transmitted through the transmitting portion 330 opposite the other diffusing portion 510 accentuates the design represented on the exterior member 300.

INDUSTRIAL APPLICABILITY

According to embodiments of the present invention, even in a dark environment devoid of external lighting, a design on an exterior member can be discerned and the design can be three-dimensionally represented by means of light radiated through the exterior member. Also, light radiated through the exterior member has the same effect as indirect lighting, to thereby alleviate emotional dissatisfaction arising from direct lighting and raise aesthetic sensibility, for a high industrial applicability.

The invention claimed is:

1. An appliance door comprising:

an outer door panel formed of a metal sheet;

a door liner disposed at a rear side of the outer door panel;

a coupling panel provided at both sides of the outer door panel to couple the outer door panel to the door liner;

a pair of supporters mounted on the outer door panel;

a transparent member mounted on the outer door panel between the pair of supports, the transparent member having a diffusing portion projected or recessed from a surface thereof to form a pattern;

a substrate located at an end of the transparent member;

a light emitting member mounted on the substrate to emit light to the transparent member;

a crystal mounted on a side of the transparent member to allow light emitted from the light emitting member to diffuse frontward; and an exterior member disposed at a front side of the crystal and formed of tempered glass or plastic material, the exterior member including:

a transmitting portion located at a site corresponding to the diffusing portion to allow the light diffused from the crystal to pass, the transmission portion not being color treated; and a printed portion being color treated to shield a portion of the light diffused from the crystal, wherein the diffusing portion includes a main part on which the crystal is received to form an inner portion of the pattern and a secondary part to form one or more contour lines of the pattern.

2. The appliance door according to claim 1, wherein the light emitting member radiates light toward an outer end of the transparent member.

3. The appliance door according to claim 1, wherein the light emitting member is a light emitting diode (LED) and is arranged in plurality continuously along an outer end of the transparent member.

4. The appliance door according to claim 1, wherein the light emitting member is provided symmetrically at either of a top and bottom or left and right side of the transparent member.

5. The appliance door according to claim 1, wherein the transmitting portion is printed to have a different light transmissivity.

6. The appliance door according to claim 1, further comprising a support plate provided behind the transparent member and on which the crystal is mounted, and wherein the main part forms an opening of the transparent member.

7. The appliance door according to claim 1, wherein the light emitting member is installed by means of a light member mount.

8. The appliance door according to claim 1, wherein the appliance door is a refrigerator door.

* * * * *